US006106767A

United States Patent [19]

Kennedy et al.

[11] Patent Number: 6,106,767

[45] Date of Patent: Aug. 22, 2000

[54] STRESS RUPTURE PROPERTIES OF NICKEL-CHROMIUM-COBALT ALLOYS BY ADJUSTMENT OF THE LEVELS OF PHOSPHORUS AND BORON

[75] Inventors: Richard L. Kennedy, Monroe; Wei-Di Cao, Charlotte, both of N.C.

[73] Assignee: Teledyne Industries, Inc.

[21] Appl. No.: 09/091,355

[22] PCT Filed: Dec. 20, 1996

[86] PCT No.: PCT/US96/19922

§ 371 Date: Jul. 17, 1998

§ 102(e) Date: Jul. 17, 1998

[87] PCT Pub. No.: WO97/23659

PCT Pub. Date: Jul. 3, 1997

[51] Int. Cl.[7] ..... C22C 19/05

[52] U.S. Cl. ..... 420/448; 420/449; 420/588

[58] Field of Search ..... 420/448, 449, 420/588; 148/428

[56] References Cited

U.S. PATENT DOCUMENTS 3,046,108 7/1962 Eiselstein .
3,865,581 2/1975 Sekino et al. .
4,476,091 10/1984 Klarstom ..... 420/443
5,372,662 12/1994 Ganesan et al. ..... 420/448
5,413,647 5/1995 Ablett et al. .
5,888,316 3/1999 Erickson ..... 420/448

OTHER PUBLICATIONS

Proceedings of the International Symposium on Superalloys, issued 1992, Zhu et al, "A New Way to Improve the Superalloys," pp. 145–154, especially the abstract, Table 1, p. 151.

*Primary Examiner*—Deborah Yee
*Attorney, Agent, or Firm*—Robert J. Pugh; Patrick Viccaro

[57] ABSTRACT

Nickel-base alloys with improved elevated temperature creep and stress rupture lives are disclosed which are particularly useful for components in gas turbine engines exposed to high temperatures and stresses for long periods of time. The alloys are nickel-based consisting essentially of 0.005 to 0.15% C, 0.10 to 11% Mo, 0.10 to 4.25% W, from 12 to 31% Cr, 0.25 to 21% Co, up to 5% Fe, 0.10 to 3.75% Nb, 0.10 to 1.25% Ta, 0.01 to 0.10% Zr, 0.10 to 0.50% Mn, 0.10 to 1% V, 1.8–4.75% Ti, 0.5 to 5.25% Al, less than 0.003% P, and 0.004 to 0.025% B. Key to the improvement of creep and stress rupture lives is the extremely low P content in conjunction with high B contents.

11 Claims, 4 Drawing Sheets

EFFECT OF B LEVEL ON STRESS RUPTURE LIFE OF WASPALOY® AT 1400°F/64 KSI (760°C/440 MPa)

COMPARISON OF STRESS RUPTURE LIFE BETWEEN COMMERCIAL WASPALOY AND MODIFIED WASPALOY®

EFFECT OF B LEVEL ON STRESS RUPTURE LIFE OF WASPALOY® AT 1400°F/64 KSI (760°C/440 MPa)

STRESS RUPTURE LIFE OF WASPALOY® AS A FUNCTION OF P AND B LEVELS

PHOSPHORUS AND BORON RANGES IN MODIFIED WASPALOY® IN COMPARISON WITH THOSE IN COMMERCIAL ALLOYS AND SPECIFICATIONS

STRESS RUPTURE PROPERTIES OF NICKEL-CHROMIUM-COBALT ALLOYS BY ADJUSTMENT OF THE LEVELS OF PHOSPHORUS AND BORON

BACKGROUND OF THE INVENTION

1. Field of Invention

This invention relates to wrought nickel-base superalloys with improved creep and stress rupture resistance and, in particular, to Ni—Cr—Co alloys solid solution strengthened by Mo and/or W, and precipitation hardened by the intermetallic compound gamma prime (γ') which has a formula of $Ni_3Al$,Ti (and sometimes Nb and Ta).

2. Description of the Prior Art

Steady advances over the years in the performance of the gas turbine engine have been paced by improvements in the elevated temperature mechanical property capabilities of nickel-base superalloys. Such alloys are the materials of choice for the largest share of the hottest components of the gas turbine engine. Components such as disks, blades, fasteners, cases, shafts, etc. are all fabricated from nickel-base superalloys and are required to sustain high stresses at very high temperatures for extended periods of time. As engine performance requirements are increased, components are required to endure higher temperatures and/or stresses or longer service lifetimes. In many cases, this is accomplished by redesigning parts to be fabricated from new or different alloys which have higher properties at higher temperatures (e.g., tensile strength, creep rupture life, low cycle fatigue, etc.). However, introduction of a new alloy, particularly into a critical rotating component of a jet engine, is a long and extremely costly process (many years and multiple millions of dollars today). Material property improvements can sometimes be achieved by means other than changing the basic alloy composition, as for example heat treatment, thermomechanical processing, microalloying, etc. These types of changes are considered less risky and can be made for substantially lower cost and much more quickly.

In the area of microalloying, the positive effect of Boron (hereinafter referred to as B) in nickel-base superalloys has been known since the late 1950's, R. F. Decker et al. in *Transactions of the AIME*, Vol. 218, (1961), page 277 and F. N. Damana et al. in *Journal of the Iron & Steel Institute*, Vol. 191, (1959), page 266 demonstrated significant improvements in rupture life for nickel-base alloys from small B additions of 0.0015% to 0.0090% by weight. Phosphorus (hereinafter referred to as P), on the other hand, is an almost unavoidable element which is present in many metallic raw materials commonly used in the manufacturing of nickel-base alloys. There is relatively little published information on the effect of P in nickel-base alloys, and what is available is somewhat contradictory. For the most part, P has been considered to be a harmful, or at best, relatively innocuous element and is controlled to relatively low maximum limits (e.g., 0.015% P and B max. in specification AMS 5706H). Recent work, however, has shown that in certain superalloy compositions, P can, in fact, be beneficial to creep and stress rupture properties. See Wei-Di Cao and Richard L. Kennedy, "The Effect of Phosphorous on Mechanical Properties of Alloy 718", *Superalloys* 718, 625, 706 *and Various Derivatives*, 1994, edited by E. A. Loria, TMS, pages 463–477. P is extremely difficult to remove in most pyrometallurgical practices and, in fact, is not changed at all in normal, commercial vacuum melting practices used to produce the alloys of this invention. Therefore, the only means of control of P is to limit the amount in the starting raw materials. With the normal variations in raw material lots, this typically leads to analyzed contents in a commercial nickel-base alloy such as described in AMS 5706H (trade name WASPALOY®, registered trademark of Pratt & Whitney Aircraft) of 0.003% to 0.008%, well within specification limits. To achieve ultra-low P contents, as required in this invention, mandates the use of special, high purity raw materials which are available, but at substantially higher costs or perhaps very specialized melting practices.

Prior to this invention, there has been no recognition of the benefits of producing nickel-base superalloys with such ultra-low P contents (<0.0030% P, or more preferably <0.001% P), and since commercial specifications of <0.015% P have been comfortably met with normal commercial raw materials, there has been a disincentive to produce alloys with very low P. However, it has been discovered that ultra-low P contents (<0.003%, or more preferably <0.001%) when employed in conjunction with higher than normal B levels (0.004% to 0.025%, or more preferably 0.008% to 0.016%) result in significantly improved creep and stress rupture life.

SUMMARY OF THE INVENTION

This invention relates to wrought nickel-base superalloys and articles made therefrom with improved creep and stress rupture resistance containing 0.005 to 0.15% C, 0.10 to 11% Mo, 0.10 to 4.25% W, 12–31% Cr, 0.25 to 21% Co, up to 5% Fe, 0.10 to 3.75% Nb, 0.10 to 1.25% Ta, 0.01 to 0.10% Zr, 0.10 to 0.50% Mn, 0.10 to 1% V, 1.8–4.75% Ti, 0.5 to 5.25% Al, less than 0.003% P, and 0.004–0.025% B. In all cases, the base element is Ni and incidental impurities.

Advantageously, the superalloy composition may contain 0.005 to 0.15% C, 3–11% Mo, 0.10 to 4.25% W, 12–21% Cr, 7–18% Co, up to 5% Fe, 0.10 to 3.75% Nb, 0.01 to 0.10% Zr, up to 0.3% Mn, 2–4.75% Ti, 1.2–4.25% Al, <0.01 P, 0.008–0.020% B, balance Ni and incidental impurities.

In one preferred embodiment, this invention relates to a wrought superalloy containing 0.02–0.10% C, 3.50–5.0% Mo, 18–21% Cr, 12–15% Co, up to 1.0% Fe, 0.4–0.10% Zr, up to 0.15% Mn, 2.75–3.25% Ti, 1.2–1.6% Al, <0.001% P, 0.008–0.016% B, balance Ni and incidental impurities.

The superalloy compositions of this invention have ultra-low P contents in combination with higher than normal B contents. One means by which such low P limits can be obtained is by the selection of expensive, high purity raw materials. The critical combination of these two elements result in significant increases in creep and stress rupture resistance over the level which can be achieved by either element acting independently.

Accordingly, it is the objective of this invention to provide wrought nickel-base superalloys suitable for use in gas turbine engines and articles made therefrom with substantially improved creep and stress rupture resistance.

DESCRIPTION OF THE PREFERRED EMBODIMENTS

It has been the general belief and understanding from the earliest days of superalloy production that P plays an insignificant role in the properties of nickel-base alloys if it is held anywhere below some nominal maximum value, e.g., 0.015% in AMS 5706H. Manufacturers and users of superalloys consider P to be a trace element which is commonly found in many raw materials, and numerous specifications and alloy patents specify and teach only that P content should not exceed some nominal maximum limit (as above). Applicants have discovered, however, that P can play a very large role in the creep and stress rupture life of nickel-base superalloys if it is controlled precisely to very critical limits within the nominal maximums that industry or previous inventors have specified. Applicants have further discovered that the effect of P is alloy specific. That is, in some alloys, e.g., the Ni—Cr—Co-base γ' precipitation hardened alloys of this invention that extremely low levels of P are critical, e.g., <0.003%, or more preferably <0.001%. Such levels are substantially lower than normal commercial practice of about 0.003–0.008%, and can only be achieved with special raw materials or manufacturing practices. However, in other alloys such as the Ni—Cr—Fe γ" precipitation hardened alloy 718, e.g., Applicants have demonstrated that a benefit to creep and stress rupture properties can be obtained by the purposeful addition of P in amounts substantially above that present in normal commercial practice (this discovery is the subject of a currently pending patent application). One preferred composition, for example, contains 0.022% which can only be obtained by the selection of special raw materials with purposefully high P contents or by the highly unusual practice of purposefully adding P in elemental or alloy form.

Figure 1:
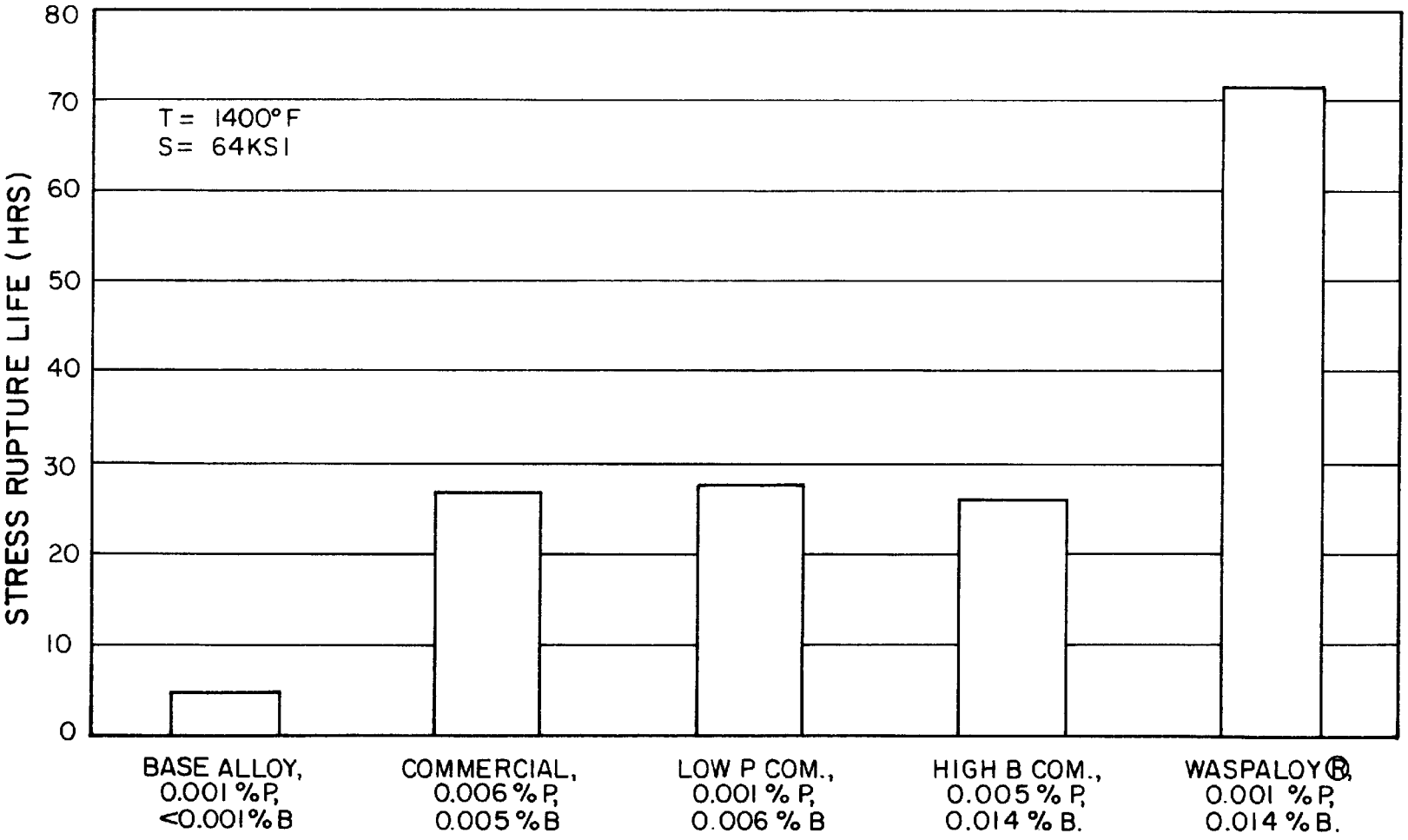
FIG. 1 compares the stress rupture life of one preferred embodiment of this invention to commercial WASPALOY® and several variations thereof.

A further critical part of these two inventions is the previously unrecognized interaction of P with B to achieve optimum creep and stress rupture resistance. Lowering P by itself to ultra low levels does not result in a significant change in stress rupture life for the Ni—Cr—Co γ' hardened alloys. Rather, the most significant and unexpected change in rupture life occurs when B is raised to higher than normal levels in combination with P at ultra low levels. This is clearly shown from FIGS. 1 and 2. It has further been discovered that the known beneficial effect of B on creep and stress rupture properties can be extended to much larger amounts of B if P is reduced to ultra low levels. This effect is also clearly shown in FIG. 2.

The benefits of ultra low P in combination with higher than normal B can be explained from an understanding of the nature of creep deformation and the behavior of P and B in nickel-base alloys. At the test conditions employed in this work, creep deformation occurs mainly by grain boundary sliding and microvoid formation. Thus, specimen failures are almost completely intergranular. P and B both segregate to grain boundaries, resulting in changes in grain boundary cohesion and modification of boundary precipitates. Many studies have shown that P and B compete for grain boundary sites, and they produce different effects. P has a stronger tendency to segregate to boundaries but has a weaker grain boundary strengthening effect than B. Therefore, if sufficient P is present, it will preferentially segregate to the grain boundaries and exclude B, resulting in a weaker alloy. Conversely, if P is held to lower than normal levels, more B can segregate to the boundaries, strengthening them and thereby raising creep resistance. This explanation is consistent with our observations that B additions at levels higher than normally employed can substantially improve creep rupture resistance, but only if P levels are held to much lower than normal levels. These results are clearly shown in Table 1 and in FIGS. 2 and 3.

TABLE 1

CHEMICAL COMPOSITION OF WASPALOY TEST ALLOYS

| Heat | Chemical Composition (wt %) | | | | | | | | | | |
|---|---|---|---|---|---|---|---|---|---|---|---|
| No. | C | S | Mo | Cr | Fe | Co | Ti | Al | Si | B | P |
| | | | | Commercial Alloys | | | | | | | |
| G752-2 | 0.036 | 0.0006 | 4.21 | 19.72 | 0.07 | 13.46 | 2.96 | 1.30 | 0.01 | 0.006 | 0.004 |
| G753-1 | 0.038 | 0.0005 | 4.21 | 19.82 | 0.07 | 13.44 | 2.97 | 1.30 | 0.01 | 0.005 | 0.006 |
| WB74 | 0.036 | 0.0006 | 4.27 | 19.81 | 0.06 | 13.40 | 3.01 | 1.31 | 0.01 | 0.005 | 0.006 |
| | | | | P-B Modified Alloys | | | | | | | |
| G757-1 | 0.037 | 0.0006 | 4.23 | 19.75 | 0.07 | 13.48 | 2.96 | 1.30 | 0.01 | <0.001 | 0.001 |
| G752-1 | 0.037 | 0.0006 | 4.19 | 19.74 | 0.07 | 13.50 | 2.92 | 1.29 | 0.01 | 0.006 | 0.001 |
| G757-2 | 0.036 | 0.0006 | 4.23 | 19.73 | 0.07 | 13.49 | 2.95 | 1.29 | 0.01 | 0.008 | 0.001 |
| WB71 | 0.032 | 0.0003 | 4.28 | 19.77 | 0.07 | 13.47 | 2.97 | 1.31 | 0.01 | 0.009 | 0.001 |
| G947-1 | 0.037 | 0.0005 | 4.27 | 19.85 | 0.08 | 13.44 | 3.00 | 1.30 | 0.01 | 0.012 | 0.001 |
| G949-1 | 0.039 | 0.0005 | 4.32 | 19.72 | 0.08 | 13.43 | 3.00 | 1.30 | 0.01 | 0.014 | 0.001 |
| WA52-1 | 0.036 | 0.0005 | 4.26 | 19.78 | 0.10 | 13.47 | 2.99 | 1.31 | 0.01 | 0.017 | 0.001 |
| WA52-2 | 0.037 | 0.0004 | 4.25 | 19.80 | 0.10 | 13.45 | 2.97 | 1.31 | 0.01 | 0.021 | 0.001 |
| WA53-1 | 0.036 | 0.0005 | 4.26 | 19.76 | 0.09 | 13.48 | 2.99 | 1.31 | 0.01 | 0.014 | 0.003 |
| G761-1 | 0.028 | 0.0005 | 4.26 | 19.74 | 0.07 | 13.45 | 3.01 | 1.31 | 0.01 | <0.001 | 0.006 |
| G761-2 | 0.028 | 0.0005 | 4.28 | 19.76 | 0.09 | 13.42 | 3.07 | 1.31 | 0.01 | 0.009 | 0.006 |
| WA53-2 | 0.037 | 0.0006 | 4.26 | 19.75 | 0.09 | 13.50 | 2.97 | 1.31 | 0.01 | 0.014 | 0.005 |
| G753-2 | 0.037 | 0.0005 | 4.22 | 19.83 | 0.07 | 13.47 | 2.98 | 1.31 | 0.01 | 0.005 | 0.008 |
| G763-1 | 0.036 | 0.0005 | 4.23 | 19.72 | 0.07 | 13.47 | 2.95 | 1.33 | 0.01 | <0.001 | 0.012 |
| G754-1 | 0.036 | 0.0006 | 4.22 | 19.72 | 0.08 | 13.42 | 2.93 | 1.35 | 0.01 | 0.005 | 0.012 |
| G754-2 | 0.037 | 0.0006 | 4.28 | 19.72 | 0.07 | 13.44 | 2.93 | 1.30 | 0.01 | 0.005 | 0.016 |
| G766-1 | 0.035 | 0.0005 | 4.28 | 19.74 | 0.08 | 13.46 | 3.03 | 1.29 | 0.01 | <0.001 | 0.022 |

TABLE 1-continued

CHEMICAL COMPOSITION OF WASPALOY TEST ALLOYS

| Heat | Chemical Composition (wt %) | | | | | | | | | | |
|---|---|---|---|---|---|---|---|---|---|---|---|
| No. | C | S | Mo | Cr | Fe | Co | Ti | Al | Si | B | P |
| G755-1 | 0.038 | 0.0006 | 4.22 | 19.76 | 0.07 | 13.42 | 2.95 | 1.28 | 0.01 | 0.005 | 0.022 |
| G766-2 | 0.037 | 0.0005 | 4.27 | 19.74 | 0.09 | 13.47 | 2.98 | 1.30 | 0.01 | 0.011 | 0.022 |

Having described the basic aspects of the invention, the following examples are given to illustrate specific embodiments thereof.

EXAMPLE 1

In order to determine the effect of P and B content on mechanical properties, a large number of 50 pound heats were prepared by vacuum induction melting. Alloys were further processed by vacuum are remelting followed by homogenization, forging and rolling to nominal ⅝" diameter bar stock. Test samples were then cut from the bar, heat treated to the standard Aeronautical Materials Specification or commercial specification requirements and tested in accordance with appropriate ASTM standards. In all cases, the only purposeful variable was the P and/or B content. The remainder of the chemistry of the alloys was kept as constant as possible, as were all of the thermomechanical processing conditions.

Chemical analysis results of a series of heats using the commercial Ni superalloy WASPALOY® as a base are presented in Table 1. Stress rupture results of these alloys are shown in Table 2. Because the stress rupture properties of WASPALOY® are so sensitive to grain size and since it is extremely difficult to reproduce exactly a constant grain size from bar to bar, even with constant process parameters, sufficient samples were prepared to determine the grain size dependence on stress rupture life. Although the grain size variation was very small (6 to 12 microns), this figure was then used to normalize the stress rupture values for different heats to the same grain size for comparison purposes. Both values (as tested and normalized) are presented in Table 2. The effects of P and B on stress rupture properties are best seen from FIGS. 1–3. From FIG. 1, it is observed that the stress rupture life for a "commercial" composition WASPALOY® (0.006% P and 0.006% B) is about 27 hours. Lowering the P to <0.001% by itself, a level far below normal commercial levels, or raising the B to 0.014% by itself, a level much above normal levels and above commercial specification limits, does not significantly change the stress rupture life for the alloy. However, if the P level is reduced to 0.001% and the B is simultaneously raised to 0.014%, the rupture life increases to 71 hours, an increase of 2.8× (280%).

TABLE 2

STRESS RUPTURE PROPERTIES OF MODIFIED WASPALOY
ALL SAMPLES HEAT TREATED:
1865° F. × 4 HRS., WQ + 1550° F. × 4 HRS., AC + 1400° F. × 16 HRS., AC

| Heat | Chemistry (wt %) | | Grain Size | S/R Properties at 1400° F./64 Ksi | | S/R Life Corrected |
|---|---|---|---|---|---|---|
| No. | B | P | D, (μm) | Life (HRS.) | EL (%) | to D = 10.5 μm |
| | | | Commercial Alloys | | | |
| G752-2 | 0.006 | 0.004 | 7.2 | 15.8 | 36.0 | 27.0 |
| G753-1 | 0.005 | 0.006 | 6.0 | 12.6 | 39.0 | |
| WB74 | 0.005 | 0.006 | 12.0 | 33.6 | 40.0 | |
| | | | P-B Modified Alloys | | | |
| G757-1 | <0.001 | 0.001 | 8.9 | 1.1 | 39.2 | 4.6 |
| G752-1 | 0.006 | 0.001 | 6.5 | 15.8 | 49.0 | 27.8 |
| G767-2 | 0.008 | 0.001 | 7.3 | 28.6 | 42.0 | 38.1 |
| WB71 | 0.009 | 0.001 | 11.2 | 51.3 | 40.5 | 49.2 |
| G947-1 | 0.012 | 0.001 | 10.5 | 54.7 | 39.5 | 54.7 |
| G949-1 | 0.014 | 0.001 | 10.3 | 70.6 | 41.0 | 71.2 |
| WA52-1 | 0.017 | 0.001 | 6.5 | 26.1 | 40.1 | 38.1 |
| WA52-2 | 0.021 | 0.001 | 7.2 | 16.6 | 46.8 | 26.4 |
| WA53-1 | 0.014 | 0.002 | 7.5 | 43.2 | 49.4 | 52.2 |
| G761-1 | <0.001 | 0.006 | 9.0 | 1.4 | 42.0 | 5.9 |
| G761-2 | 0.009 | 0.006 | 8.5 | 16.7 | 39.5 | 22.7 |
| WA53-2 | 0.014 | 0.005 | 8.5 | 19.9 | 50.5 | 25.9 |
| G753-2 | 0.005 | 0.008 | 7.5 | 18.8 | 44.0 | 27.8 |
| G763-1 | <0.001 | 0.012 | 8.5 | 3.6 | 11.5 | 9.6 |
| G754-1 | 0.005 | 0.012 | 7.0 | 15.6 | 37.5 | 26.1 |
| G754-2 | 0.005 | 0.016 | 9.5 | 19.4 | 43.6 | 22.4 |
| G766-1 | <0.001 | 0.022 | 8.0 | 4.3 | 19.5 | 11.8 |
| G755-1 | 0.005 | 0.022 | 7.6 | 12.4 | 39.0 | 21.4 |
| G766-2 | 0.011 | 0.022 | 10.3 | 16.3 | 43.0 | 16.9 |

Figure 2:
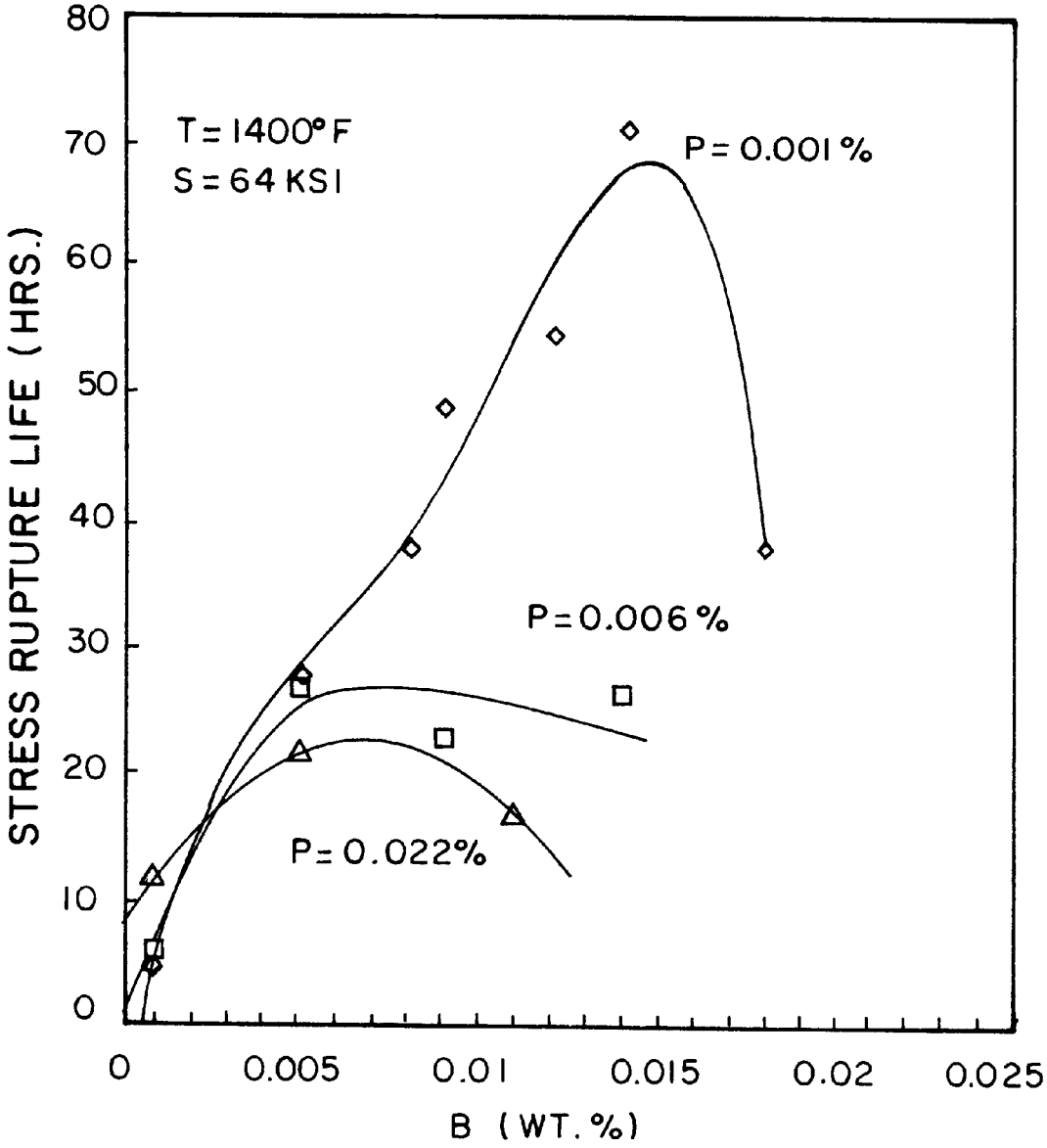
FIG. 2 compares the stress rupture life of a nominal WASPALOY® base composition with variations of both P and B.

The interdependence of the stress rupture life of WASPALOY® on P and B content is more clearly illustrated in FIG. 2 based on normalized data. Here, it can be seen that if the P content of the alloy is at 0.006% (normal commercial levels) or higher (0.022%), stress rupture life never exceeds about 30 hours, regardless of B content. Further, at these P levels, it appears that the beneficial effect of B saturates or reaches its maximum value at about 0.005% B which is approximately the normal commercial level for WASPALOY®. Beyond this level, further additions of B do not raise stress rupture life. In contrast, with an exceptionally low P level of 0.001%, stress rupture life of WASPALOY® increases continuously with B additions at least up to 0.014%.

Figure 3:
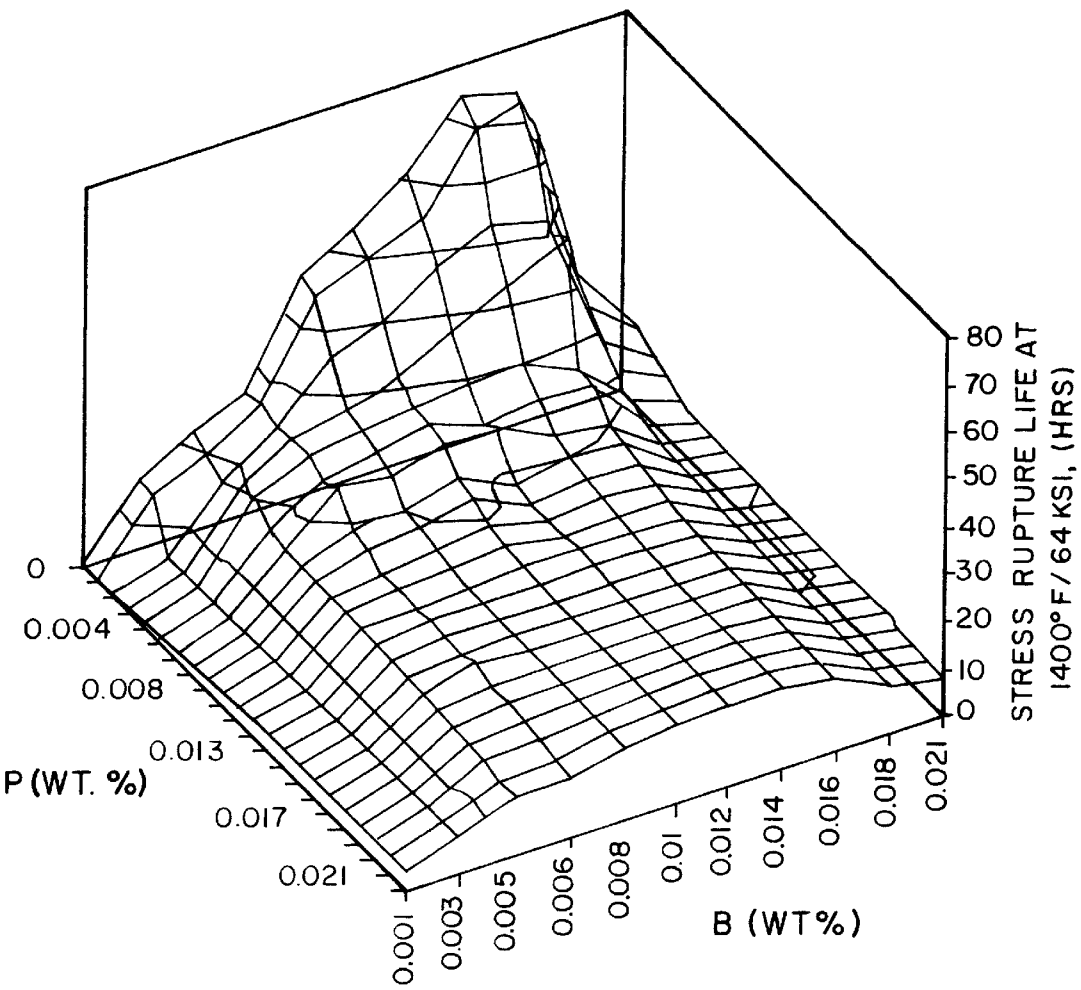
FIG. 3 is a three-dimensional graph showing the strong inter-relationship of P and B on the stress rupture life of a nominal WASPALOY®-base composition.

The critical inter-relationship of P and B with stress rupture life of WASPALOY® is shown even more clearly in FIG. 3. Over the full range of P and B contents investigated, exceptional rupture lives are displayed only at extremely low P levels <0.003% and more preferably <0.001%, and at higher than normal B levels 0.008% to 0.016% and more, preferably 0.012% to 0.016%.

Figure 4:
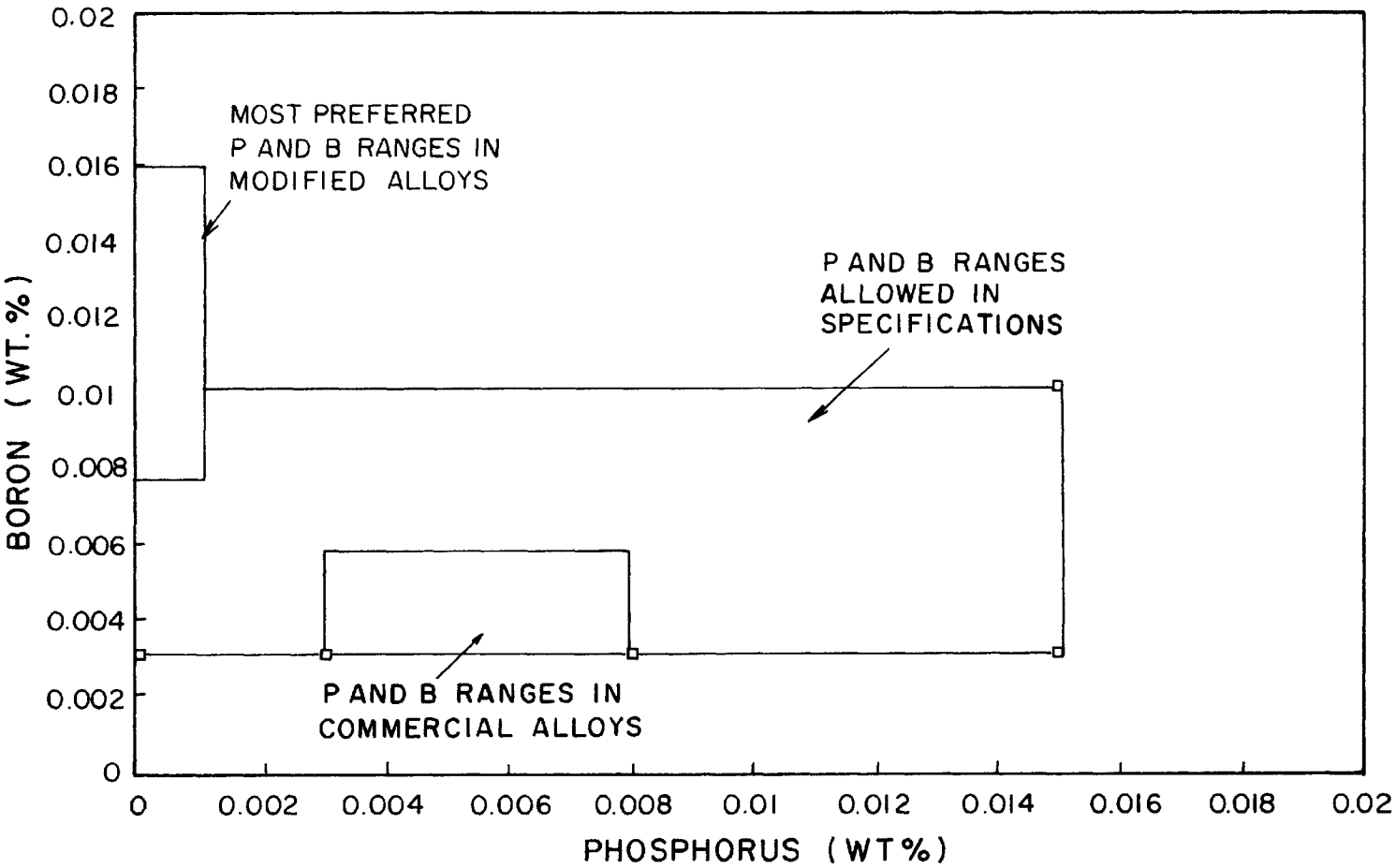
FIG. 4 compares the most preferred P and B compositional ranges of this invention to current commercial practice and specification limits of WASPALOY®.

FIG. 4 shows the preferred ranges for P and B in an alloy of this invention for substantially improved stress rupture life compared to the level typically practiced in commercial WASPALOY® and the ranges allowed by typical commercial specifications.

EXAMPLE 2

A series of test heats of a commercial Ni—Co—Cr precipitation hardened superalloy designated GTD-222 were prepared using exactly the same manufacturing practices as described in Example 1. The resulting bar was solution treated and aged in accordance with commercial specification requirements prior to testing. The only purposeful changes in composition again were P and B. The aim composition for the remaining elements was held constant. The slight variations observed in Table 3 are typical of those encountered in manufacturing and chemical analysis of these materials.

TABLE 3

CHEMICAL COMPOSITION OF GTD-222 TEST ALLOYS

| Heat | Chemical Composition (wt %) | | | | | | | | | | |
|---|---|---|---|---|---|---|---|---|---|---|---|
| No. | C | S | W | Cr | Co | Nb | Ta | Al | Ti | B | P |
| | | | | | Commercial Alloys | | | | | | |
| WC24 | 0.082 | 0.0006 | 2.11 | 22.35 | 19.24 | 0.77 | 0.99 | 1.19 | 2.35 | 0.0038 | 0.007 |
| | | | | | P-B Modified Alloys | | | | | | |
| WC21 | 0.085 | 0.0007 | 2.10 | 22.25 | 19.07 | 0.76 | 0.98 | 1.16 | 2.38 | <0.001 | 0.003 |
| WC22 | 0.082 | 0.0006 | 2.14 | 22.73 | 19.33 | 0.81 | 0.98 | 1.34 | 2.36 | 0.0042 | 0.003 |
| WC23 | 0.080 | 0.0005 | 2.16 | 22.37 | 19.28 | 0.77 | 0.99 | 1.26 | 2.37 | 0.0108 | 0.003 |
| WC27 | 0.080 | 0.0007 | 2.15 | 22.39 | 19.32 | 0.77 | 1.01 | 1.17 | 2.37 | <0.001 | 0.017 |
| WC26 | 0.078 | 0.0006 | 2.13 | 22.21 | 19.23 | 0.77 | 0.99 | 1.20 | 2.36 | 0.0046 | 0.020 |
| WC25 | 0.081 | 0.0006 | 2.15 | 22.36 | 19.21 | 0.76 | 0.98 | 1.17 | 2.39 | 0.0086 | 0.020 |

Table 4 presents the stress rupture results for this series of alloys. These data clearly show that changes in P or B content by themselves do not allow achieving optimum stress rupture life. Although the lowest P level achieved in this series of experiments was 0.003%, when combined with the highest level of B at 0.0106% B, a maximum stress rupture life of 76.2 hours (average) and the best elongation were achieved in the 1400° F.-67 ksi test. Maximum results were obtained at 1600° F.-30 ksi test conditions with peak rupture life and ductility at 0.003% P and 0.0042% B.

TABLE 4

Stress Rupture Properties of Modified Alloy GTD-222
ALL SAMPLES HEAT TREATED:
2100° F. × 1 HR., WQ + 1475° F. × 8 HRS., WQ

| Heat | Chemistry | | S/R, 1400° F./67 ksi | | S/R, 1600° F./30 ksi | |
|---|---|---|---|---|---|---|
| No. | P | B | Life (hrs) | EL (%) | Life (hrs) | EL (%) |
| WC-21 | 0.003 | <0.001 | 3.8 | 2.0 | 17.0 | 10.0 |
| | | | 2.2 | 0 | 13.1 | 9.0 |
| | | | av. 3.0 | av. 1.0 | av. 15.1 | av. 9.5 |
| WC-22 | 0.003 | 0.0042 | 48.6 | 6.0 | 54.6 | 21.0 |
| | | | 67.7 | 9.0 | 44.7 | 23.0 |
| | | | av. 58.3 | av. 7.5 | av. 49.7 | av. 22.0 |

TABLE 4-continued

Stress Rupture Properties of Modified Alloy GTD-222
ALL SAMPLES HEAT TREATED:
2100° F. × 1 HR., WQ + 1475° F. × 8 HRS., WQ

| Heat | Chemistry | | S/R, 1400° F./67 ksi | | S/R, 1600° F./30 ksi | |
|---|---|---|---|---|---|---|
| No. | P | B | Life (hrs) | EL (%) | Life (hrs) | EL (%) |
| WC-23 | 0.003 | 0.0106 | 70.0 | 12.0 | 48.6 | 19.0 |
| | | | 82.4 | 10.0 | 43.0 | 20.0 |
| | | | av. 76.2 | av. 11.0 | av. 45.8 | av. 19.5 |
| WC-24 | 0.007 | 0.0038 | 36.6 | 6.0 | 41.2 | 18.0 |
| | | | 39.0 | 7.0 | 37.2 | 20.0 |
| | | | av. 37.8 | av. 6.5 | av. 39.2 | av. 19.0 |
| WC-27 | 0.017 | <0.001 | 4.6 | 2.0 | 11.5 | 2.5 |
| | | | 5.4 | 0.5 | 12.7 | 4.0 |
| | | | av. 5.0 | av. 1.3 | av. 12.1 | av. 3.3 |
| WC-26 | 0.020 | 0.0046 | 34.1 | 4.0 | 38.1 | 14.0 |
| | | | 33.4 | 3.5 | 41.3 | 13.0 |
| | | | av. 33.8 | Av. 3.8 | Av. 39.7 | Av. 13.5 |

TABLE 4-continued

Stress Rupture Properties of Modified Alloy GTD-222
ALL SAMPLES HEAT TREATED:
2100° F. × 1 HR., WQ + 1475° F. × 8 HRS., WQ

| Heat | Chemistry | | S/R, 1400° F./67 ksi | | S/R, 1600° F./30 ksi | |
|---|---|---|---|---|---|---|
| No. | P | B | Life (hrs) | EL (%) | Life (hrs) | EL (%) |
| WC-25 | 0.020 | 0.0086 | 54.9 | 6.0 | 38.9 | 12.0 |
| | | | 56.4 | 6.0 | 33.1 | 10.0 |
| | | | av. 55.7 | av 6.0 | av. 36.0 | av. 11.0 |

It is understood that the foregoing detailed description is given merely by way of illustration and that many variations may be made therein without departing from the spirit of this invention.

What is claimed is:

1. A nickel-base alloy having improved elevated temperature creep and stress rupture life comprising in weight percent 0.005 to 0.15% C;

0.10 to 11% Mo;

0.10 to 4.25% W;

12–31% Cr;

0.25 to 21% Co;

up to 5% Fe;

0.10 to 3.75% Nb;

0.10 to 1.25% Ta;

0.01 to 0.10% Zr;

0.10 to 0.50% Mn;

0.10 to 1.0% V;

1.8–4.75% Ti;

0.50–5.25% Al;

less than 0.003% P;

0.004–0.025% B; and balance Ni and incidental impurities.

2. A nickel-base alloy according to claim 1, wherein the alloy comprises 0.005 to 0.15% C;

3–11% Mo;

0.10 to 4.25% W;

12–21% Cr;

7–18% Co;

up to 5% Fe;

0.10 to 3.75% Nb;

0.01 to 0.10% Zr;

up to 0.30% Mn;

2–4.75% Ti;

1.2–4.25% Al;

less than 0.001% P;

0.008–0.020% B; and balance Ni and incidental impurities.

3. A nickel-base alloy according to claim 2, wherein the alloy comprises 0.02–0.10% C;

3.5–5.0% Mo;

18–21% Cr;

12–15% Co;

up to 1% Fe;

0.4–0.10% Zr;

up to 0.15% Mn;

2.75–3.25% Ti;

1.2–1.6% Al;

less than 0.001% P;

0.008–0.0160% B; and balance Ni and incidental impurities.

4. A method of improving the stress rupture life of Ni—Cr—Co alloys comprising the steps of increasing the boron content of the alloy to a value of from 0.004 to 0.025% by weight and decreasing the phosphorus content to a value of less than 0.003% by weight.

5. The method of claim 4 wherein the phosphorus content is less than 0.001% by weight.

6. A method of improving the stress rupture life of an alloy consisting essentially of 0.005 to 0.15% C;

0.10 to 11% Mo;

0.10 to 4.25% W;

12–31% Cr;

0.25 to 21% Co;

up to 5% Fe;

0.10 to 3.75% Nb;

0.10 to 1.25% Ta;

0.01 to 0.10% Zr;

0.10 to 0.50% Mn;

0.10 to 1.0% V;

1.8–4.75% Ti;

0.50–5.25% Al; and balance Ni and incidental impurities, comprising the steps of:

adjusting the boron content of said alloy to a value of from 0.004 to 0.025% by weight of the alloy and adjusting the phosphorus content of said alloy to a value less than 0.003% by weight.

7. A method of improving the stress rupture life of an alloy consisting essentially of 0.005 to 0.15% C;

3–11% Mo;

0.10 to 4.25% W;

12–21% Cr;

7–18% Co;

up to 5% Fe;

0.10 to 3.75% Nb;

0.01 to 0.10% Zr;

up to 0.30% Mn;

2–4.75% Ti;

1.2–4.25% Al; and balance Ni and incidental impurities, comprising the steps of:

adjusting the boron content of said alloy to a value of from 0.008 to 0.020% by weight of the alloy and adjusting the phosphorus content of said alloy to a value less than 0.003% by weight.

8. The method of claim 7 wherein the phosphorus content is less than 0.001% by weight.

9. A method of improving the stress rupture life of an alloy consisting essentially of 0.02–0.10% C;

3.5–5.0% Mo;

18–21% Cr;

12–15% Co;

up to 1% Fe;

0.4–0.10% Zr;

up to 0.15% Mn;

2.75–3.25% Ti;

1.2–1.6% Al; and balance Ni and incidental impurities, comprising the steps of:

adjusting the boron content of said alloy to a value of from 0.008 to 0.0160% by weight of the alloy and adjusting the phosphorus content of said alloy to a value less than 0.003% by weight.

10. The method of claim 9 wherein the phosphorus content is less than 0.001% by weight.

11. A method of improving the stress rupture life of Ni—Cr—Co alloys to a value greater than 30 hours when measured at 1400° F. and 64 ksi comprising the steps of adjusting the boron content of the alloy to a value of from 0.009 to 0.016% by weight of the alloy and adjusting the phosphorus content to a value of less than 0.001% by weight.

* * * * *